United States Patent [19]

Ohmori

[11] 4,158,498

[45] Jun. 19, 1979

[54] BLADE CLEANING SYSTEM FOR A REPRODUCING APPARATUS

[75] Inventor: Hitoshi Ohmori, Ebina, Japan

[73] Assignee: Rank Xerox Limited, London, England

[21] Appl. No.: 808,585

[22] Filed: Jun. 21, 1977

[30] Foreign Application Priority Data

Jun. 22, 1976 [JP] Japan ..... 51/81052[U]

[51] Int. Cl.[2] ..... G03G 21/00

[52] U.S. Cl. ..... 355/15; 15/256.51; 118/652

[58] Field of Search ..... 355/3 R, 3 DD, 15; 118/652; 15/256.5, 256.51, 256.52

[56] References Cited

U.S. PATENT DOCUMENTS 3,759,220 9/1973 Saito et al. ..... 355/15 X 3,847,480 11/1974 Fisher ..... 355/15

*Primary Examiner*—Fred L. Braun

[57] ABSTRACT

A reproducing apparatus includes a blade cleaning system for removing residual material from an imaging surface. The blade is arranged for movement between a first position wherein an edge thereof engages the imaging surface to remove the residual material, and a second position wherein the edge is spaced from the imaging surface. Responsive to a movement of the blade to the second position a device is provided for removing residual material from the blade edge. A supply of lubricating agent is stored in a suitable container arranged above the device for cleaning the blade edge. A dispensing system is responsive to engagement between the blade and the blade edge cleaning device for dispensing a desired amount of lubricating agent onto the blade edge.

5 Claims, 3 Drawing Figures

FIG. 1
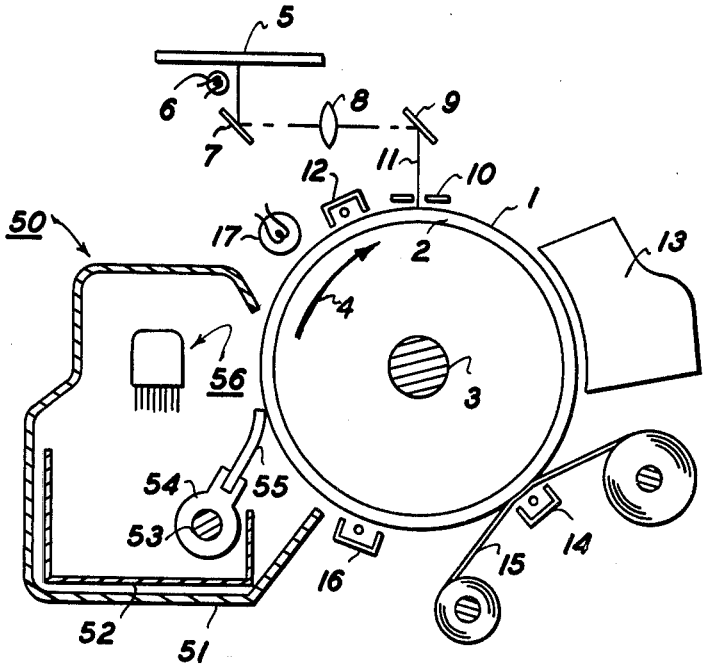
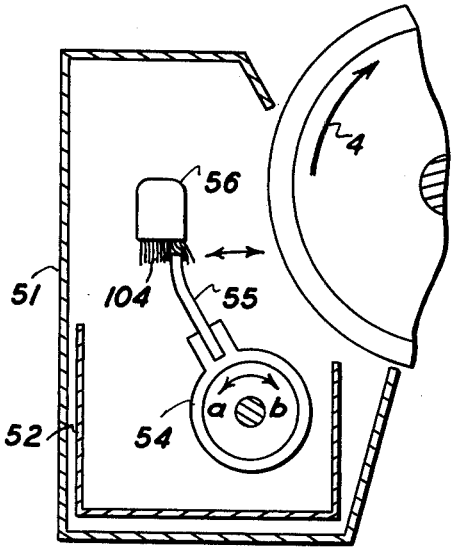
FIG. 3
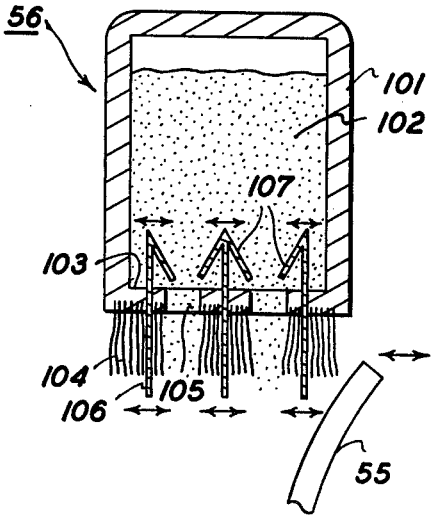
FIG. 2

BLADE CLEANING SYSTEM FOR A REPRODUCING APPARATUS

BACKGROUND OF THE INVENTION

This invention relates to a cleaning apparatus employing a doctor blade for use in an electrophotographic copier.

In an ordinary dry type electrophotographic copier, a series of copying process steps comprise: forming a latent image of an original on a rotating photosensitive drum coated with a photoconductive insulating substance on its surface; rendering visible the latent image by a developing step using a developing agent comprising a toner, made of a resin powder colored by a coloring agent such as carbon black, and a carrier. In a transcribing step, the visible toner image is transferred to an image supporting body such as paper. A portion of the toner inevitably remains on the surface of the photosensitive drum. This residual toner must be removed by a cleaning apparatus before the copier proceeds to a subsequent copying operation. The photosensitive drum from which the residual toner has been removed is then irradiated by a lamp thereby discharging any residual potential from the surface of the drum.

As for the cleaning apparatus for removing the residual toner, a doctor blade cleaning device made of a polyurethane sheet has been widely used in place of a device such as a rotating brush made of rayon wool or the like.

The doctor blade cleaning apparatus is advantageous in that the size thereof is smaller than the device having a rotating brush. Its electrical power consumption is low, and no vacuum mechanism is required. However, since the doctor blade is brought into contact with the surface of the photosensitive drum for scraping off the residual toner, the doctor blade is susceptible to the intrusion of foreign matter into the nip between the doctor blade edge and the photosensitive drum. Furthermore, there has been a tendency for the removed toner to not entirely drop off the doctor blade but to be partly retained at the blade edge. These phenomena not only reduce the cleaning effect of the doctor blade cleaning apparatus, but also tend to damage the photosensitive substance of the drum. The foreign matter consists mostly of carrier particles and paper dust, which deteriorate the cleaning ability of the apparatus and degrade the copies obtained from the copier. Furthermore, since the doctor blade in the doctor blade cleaning apparatus is brought into contact with the photosensitive drum under a predetermined pressure, a lubricating agent is normally applied for reducing the frictional resistance between the blade edge and the drum.

Lubricating agents such as zinc stearate ($Zn(C_{17}H_{35}COO)_2$), polyvinylidene fluoride ($—CF_2—CH_2—$) and the like have been widely used. They are applied by the developing agent by being mixed with the toner. However, it has been found that toner containing such lubricating agents accelerates the deterioration of the developing agent. The reason for this is that the lubricating agent impacts and coats the carrier thereby preventing the normal triboelectric charging by friction between the toner and carrier. For this reason, mixing the lubricating agent in the toner is not desirable. Furthermore, since the above described lubricating agents can comprise white powder of a comparable grain size to that of the toner, it has been found that white dots appear in the copies obtained by the copying process. These dots are not desirable and they reduce the quality of the finished copies.

SUMMARY OF THE INVENTION

The present invention is intended to overcome the above-noted problems. It is an object of this invention to provide a doctor blade cleaning apparatus wherein the doctor blade can be separated from the photosensitive drum at a predetermined cyclic interval and means provided to scrape off the toner and other foreign matter present at the edge of the doctor blade. It is a further object of this invention to supply a lubricating agent to the edge of the doctor blade while it is separated from the photosensitive drum.

The invention will now be described in more detail with reference to accompanying drawings and description.

BRIEF DESCRIPTION OF THE DRAWINGS

FIG. 1 is a schematic view of the general construction of an ordinary electrophotographic copier including a doctor blade cleaning apparatus according to this invention.

FIG. 2 is a side view of an apparatus of this invention for cleaning the edge of the doctor blade and for supplying a lubricating agent to the blade edge.

FIG. 3 is a side view of the cleaning apparatus illustrating the operation of the doctor blade cleaning device.

DETAILED DESCRIPTION OF THE PREFERRED EMBODIMENTS

In FIG. 1, a photosensitive drum 2, is coated with a photoconductive insulating substance 1. The drum is rotated about a shaft 3 in the arrow-marked direction 4, so that the entire surface of the photosensitive drum 2 is electrically charged by a charging "corotron" 12. The original 5 to be copied is successively irradiated by a lamp 6, and the image thereof is transmitted by a mirror 7, a lens 8, and another mirror 9, along a light path 11, to the photosensitive drum 2 so that the drum is exposed to form a latent image of the original 5 on its surface. A slit 10 is provided for adjustment the amount of the exposure.

The surface 1 of the photosensitive drum 2, on which that latent image of the original 5 is formed, is then advanced to a developing station where a developing apparatus 13 including a suitable developing device applies toner to the surface 1 thereby rendering the latent image visible. The visible toner image is then transferred onto an image supporting material 15 by another "corotron" 14. The toner image on the supporting material 15 is permanently fixed by a suitable fixing apparatus (not shown).

The photosensitive drum 2 after transfer is moved past a precleaning "corotron" 16 so that the residual toner on the drum is thereby made easily removable by the subsequent doctor blade cleaning device 50 which completely removes the toner from the drum 2. The surface of the photosensitive drum 2 is thereafter irradiated by a lamp 17 so that the remaining electric charge is discharged and the drum 2 is placed in a state ready for the next copying cycle.

The doctor blade cleaning apparatus 50 has an outer housing 51 in which a toner receiving box 52 is provided to be displaceable in and out of the casing 51. A doctor blade 55 is supported therein by a blade holder 54 supported by a swingable shaft 53. The blade holder 54 is ordinarily rotated in a clockwise direction as viewed in the drawing, so that the doctor blade 55 is urged against the surface of the photosensitive drum 2 under a suitable pressure. A mechanism 56 for cleaning the doctor blade 55 and applying a lubricating agent to the doctor blade when it is rotated away from the surface of the drum 2 and brought into contact with the mechanism 56, is also provided in the casing 51.

The mechanism 56 has a construction as shown in FIG. 2, wherein an envelope 101 for storing a lubricating agent 102 has a bottom wall 103. Cleaning brushes 104 are implanted in a spaced apart relation in wall 103. A number of holes 105 for delivering the lubricating agent 102 are provided in wall 103. The cleaning brushes 104, include a number of swingable plates 106 made of resilient material. The inner ends of the swingable plates 106 penetrating the bottom wall 103 of the envelope 101 and are bent into blades 107 forming in combination funnel-like configurations.

The doctor blade cleaning apparatus operates as follows. When the copying process of the electrophotographic copier terminates, and when the rotation of the photosensitive drum 2 stops, the doctor blade 55 supported by the holder 54 is rotated by the shaft 53 in the direction of the arrow so that it is separated from the surface of the photosensitive drum 2 and brought into contact with the brushes 104. When the doctor blade 55 engages the brushes 104, toner and any foreign matter collected on the doctor blade edge are removed therefrom. Simultaneously the swingable plates 106 included in the brushes 104 are forced to swing in one direction. The swinging of the swingable plates 106 causes their inner ends comprising blades 107 to move slightly thereby delivering a required amount of the lubricating agent through the holes 105 onto the edge of the doctor blade 55. Thus, the edge of the doctor blade 55 is cleaned and supplied with a required amount of the lubricating agent 102. After the completion of the above described cleaning and lubricant supplying operations, the doctor blade 55 is rotated in the direction of the arrow through the shaft 53 and the blade holder 54 until the doctor blade 55 abuts against the surface of the photosensitive drum 2 at a predetermined pressure.

The reciprocable swinging movement of the doctor blade 55 around the center of the shaft 53 may be accomplished by the use of any suitable driving means (not shown) such as an electric motor or a solenoid, which are not limitative to the scope of the present invention.

The cleaning brushes 104 may be made of nylon fibers or bristles which have been found satisfactory to accomplish their cleaning function. However, any other material which does not damage the doctor blade may also be used for the construction of the cleaning brushes 104.

The above described swinging movement of the doctor blade 55 is effectuated at times when the movement of the photosensitive drum terminates and the coping operation of the electrophotographic copier is not processing. This can be accomplished by a conventional control circuit utilizing a timer and suitable relays (not shown).

As described above, according to the present invention a doctor blade cleaning apparatus is provided wherein toner and any other foreign matter which might collect on the doctor blade edge contacting the photosensitive drum, can be removed from the doctor blade. Simultaneously therewith a suitable amount of a lubricating agent can be supplied to the doctor blade. Thus, by putting the invention into practice, a high quality cleaning operation can be maintained for a long period, while any possibility of damaging the doctor blade and the photosensitive drum can be eliminated, and the delivering of clear copies can be assured.

In the above description, although the photosensitive drum has been rotated in the clock-wise direction, the positional relation between the doctor blade 55 and the photosensitive drum 2 is constant and is not varied by the rotating direction of the photosensitive drum 2, such as a clockwise direction or a counter-clockwise direction, or a position along the circumference of the drum 2 where the doctor blade 55 contacts the photosensitive drum. Hence it is apparent that the present invention can be put into practice without being restricted to the rotating direction of the photosensitive drum 2 and the contacting position of the doctor blade 55.

Since the present invention has been constituted as described above, the cleaning of the contacting edge of the doctor blade 55 and the furnishing of the lubricating agent to the edge of the doctor blade can be carried out simultaneously.

Furthermore, because of the above described advantageous feature of the present invention, the surface of the photosensitive drum can be maintained clean for a long period and in an assured manner, and the lubricating agent can be supplied to the contacting part between the doctor blade 55 and the photosensitive drum 2 without deteriorating the developing agent.

What is claimed is:

1. In a reproducing apparatus including:
an imaging surface;
blade means for removing residual material from said surface, the blade means being arranged for reciprocal movement between a first position wherein a cleaning edge thereof engages said imaging surface to remove said residual material, and a second position spaced from said imaging surface; and
means responsive to the movement of said blade means to said second position for removing said residual material from said cleaning edge; the improvement wherein, said apparatus further comprises:
means for holding a supply of lubricating agent; and
means for dispensing said lubricating agent onto said cleaning edge of said blade at said second position, said dispensing means being actuated by engagement of said blade means with said means for removing said residual material from said cleaning edge of said blade.

2. An apparatus as in claim 1, wherein said means for removing said residual material from said cleaning edge of said blade comprises a brush having a plurality of bristles arranged to be engaged by said blade edge as said blade is moved from said first position to said second position.

3. In a reproducing apparatus including:
an imaging surface:
blade means for removing residual material from said surface, the blade means being arranged for movement between a first position wherein a cleaning edge thereof engages said imaging surface to remove said residual material, and a second position spaced from said imaging surface; and
a brush having a plurality of bristles responsive to the movement of said blade means to said second position for removing said residual material from said cleaning edge; the improvement wherein, said apparatus further comprises:

a container disposed near the brush for holding a supply of lubricating agent; and means for dispensing said lubricating agent onto said cleaning edge of said blade at said second position, said dispensing means being actuated by engagement of said blade means with said brush for removing said residual material from said cleaning edge of said blade, and said dispensing means comprising a plurality of holes in said container arranged adjacent said brush, whereby said lubricating agent is dispensed from said container for application by said brush to said blade edge, said dispensing means further comprising a plurality of spaced apart flexible plate members inter-meshed with said brush bristles and extending into said container.

4. An apparatus as in claim 3, wherein the ends of said flexible plate members which extend into said container are bent to form a funnel-like arrangement with a flexible member adjacent thereto.

5. An apparatus as in claim 4, wherein said brush bristles and said flexible members are embedded in a bottom portion of said container and wherein said holes are present in said bottom portion of said container, whereby engagement of said brush bristles and said members by said blade causes said ends of said members to move to dispense said lubricating agent.

* * * * *